United States Patent [19]

Chou-Sheng

[11] Patent Number: 4,852,762

[45] Date of Patent: Aug. 1, 1989

[54] CHILD'S CANTEEN

[75] Inventor: Huang Chou-Sheng, Taipei, Taiwan

[73] Assignee: Pecoware Products, Inc., City of Industry, Calif.

[21] Appl. No.: 246,633

[22] Filed: Sep. 19, 1988

[51] Int. Cl.[4] ..... B65D 47/12

[52] U.S. Cl. ..... 220/90.2; 215/1 A; 215/229; 222/507

[58] Field of Search ..... 220/90.2, 90.4; 215/1 A, 229; 222/507

[56] References Cited

U.S. PATENT DOCUMENTS 3,371,827 3/1968 Micallef ..... 222/507

4,448,316 5/1984 Hiroshige ..... 220/90.2 X

*Primary Examiner*—Donald F. Norton

*Attorney, Agent, or Firm*—Keith D. Beecher

[57] ABSTRACT

A child's liquid drink container in the form of a canteen which is equipped with a drinking straw. The canteen has a dome-shaped rotatable cover with a hole in one side. The cover may be rotated to a first angular position in which an internal closure member closes the hole with the straw retracted into the cover. The cover may also be rotated to a second angular position in which the closure member moves away from the hole and in which the straw is caused to project out through the hole. This enables one to drink the liquid contained in the canteen quickly and easily and without the need to remove the cover.

3 Claims, 2 Drawing Sheets

CHILD'S CANTEEN

BACKGROUND OF THE INVENTION

The principal objective of the present invention is to provide a child's canteen which may be conveniently carried on camping trips, picnics, games, or the like.

The canteen of the invention may conveniently be filled, for example, with water, lemonade, or other drinks. The canteen features a rotatable cover which may be turned to cause a drinking straw to pop-out through a hole in one side of the cover for convenient drinking of the liquid in the canteen without the need to remove the cover. The cover may then be turned to a second position to cause the straw to be retracted back into the cover and to cause an internal closure member to move across the hole.

DETAILED DESCRIPTION OF THE ILLUSTRATED EMBODIMENT

Figure 2:
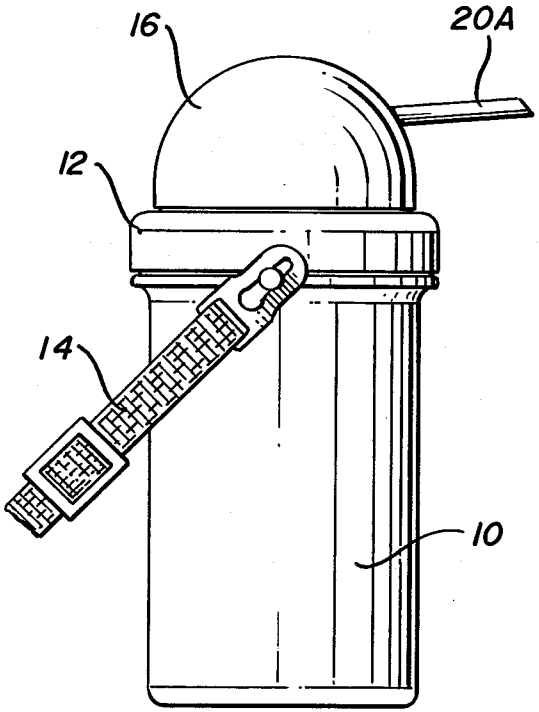
FIG. 2 is another elevational view of the canteen turned 90° on its longitudinal axis with respect to the view of FIG. 1, and with its cover turned to a position such that a drinking straw is caused to project out through the hole in the cover.
Figure 1:
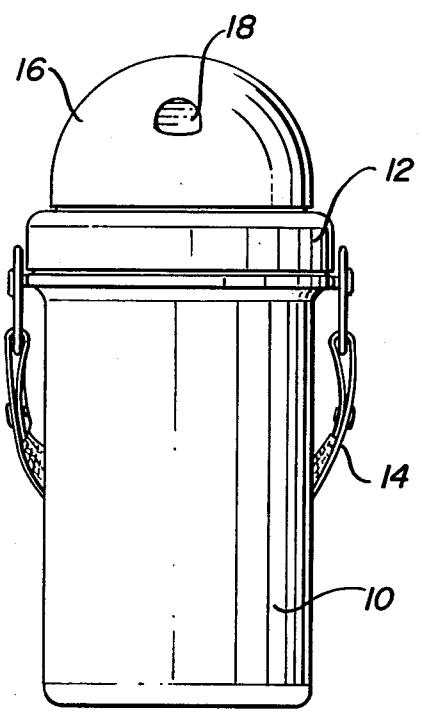
FIG. 1 is an elevational view of a canteen construction to embody the concepts of the present invention, and having its top cover turned to a position in which a hole in the cover is covered by a closure member.
Figure 3:
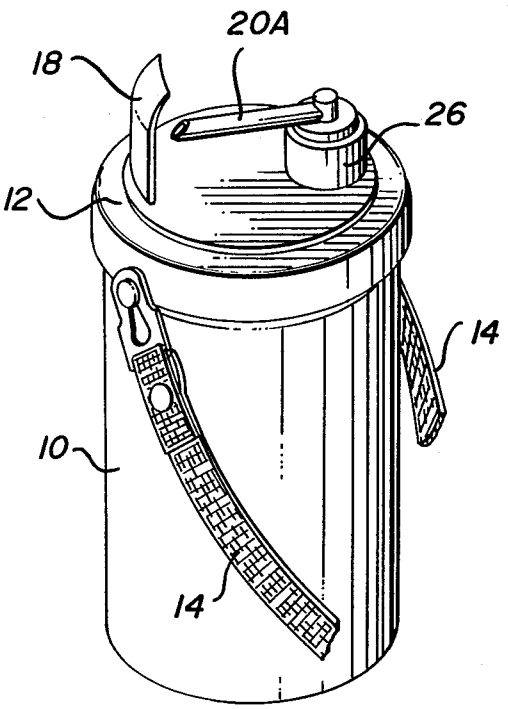
FIG. 3 is an elevational view of the canteen with the cover removed to reveal certain internal operating components.

The canteen shown in FIGS. 1–3 includes, for example, a cylindrical-shaped drink container 10 having a cap 12 threaded to its open upper end. The canteen may be conveniently carried by a flexible shoulder strap 14 which is pivoted to the upper rim of the container 10.

A cover 16 is rotatably mounted on cap 12. Cover 16 may be turned on the cap to the position shown in FIG. 1 in which a hole in the cover is closed by an internal closure member 18 mounted on cap 12. Cover 16 may also be turned on cap 12 to the position shown in FIG. 2, in which the upper tubular portion 20A of an internal drinking straw is caused to project out through the cover.

Accordingly, when the cover 16 is turned on cap 12 to the position shown in FIG. 1, the upper tubular portion 20A is withdrawn into the cover, and the hole in the cover is closed by the closure member 18. In order to drink the contents of the container, the cover is turned to the position shown in FIG. 2, in which the closure member 18 is angularly displaced from the hole, and the tubular portion 20A of the drinking straw protrudes out through the cover.

Figure 4:
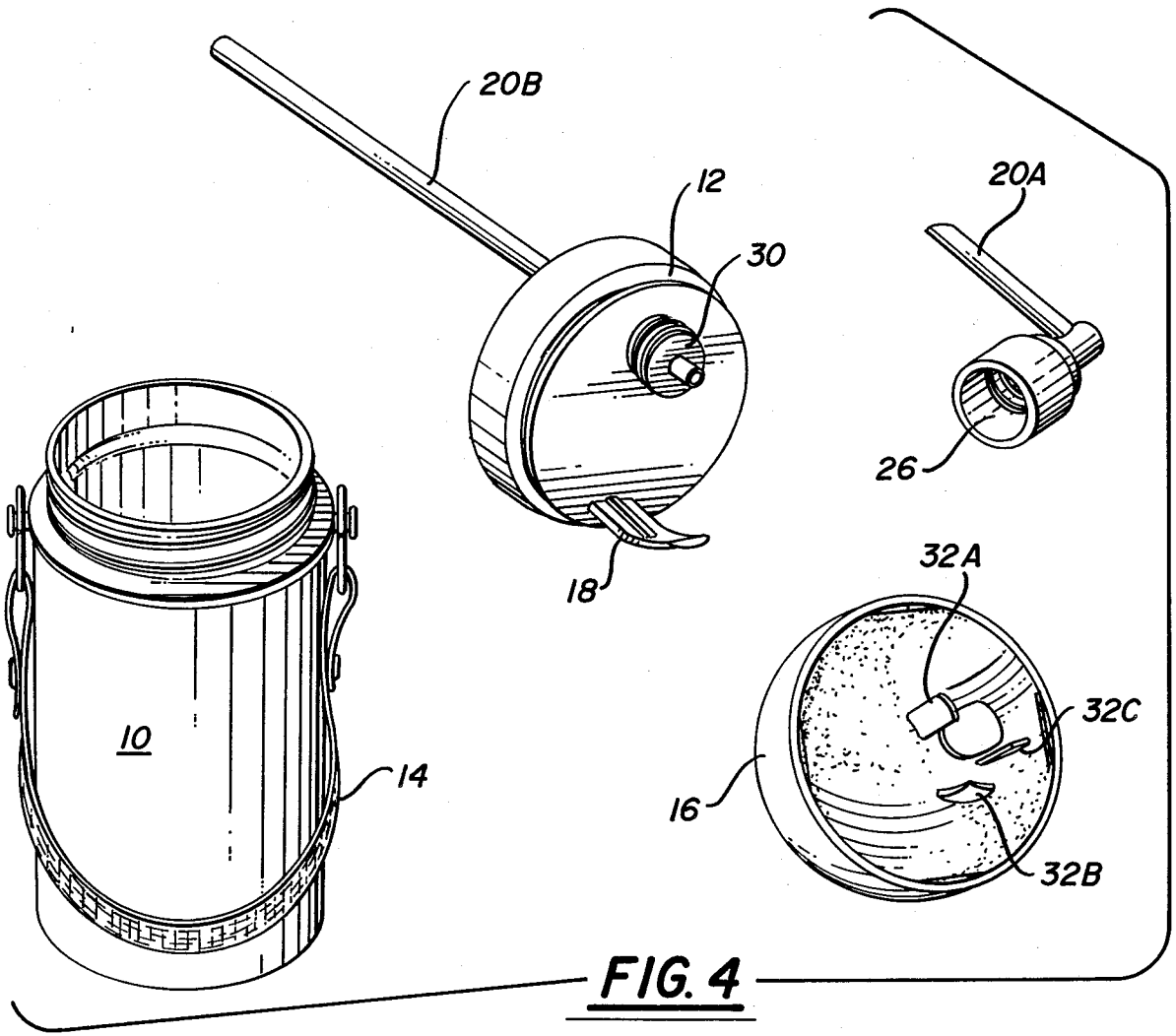
FIG. 4 is an exploded perspective view showing the various components which make up the canteen.

As shown in FIGS. 3 and 4, the upper tubular portion 20A extends into a cap 26 which is rotatably mounted on a bushing 30. Bushing 30 is mounted on top 12 at a position displaced from the center of the top. A lower tubular portion 20B of the drinking straw extends into the underside of bushing 30 and down into the interior of the container 10. The lower tubular portion 20B of the drinking straw is coupled to the upper tubular portion 20A through bushing 30.

Cover 16 has projections 32A, 32B and 32C on its inner surface. The projections 32A and 32B engage opposite sides of the upper tubular portion 20A as cover 16 is turned, causing it to rotate with cover 26 about the axis of bushing 30. As shown in FIG. 3, the closure member 18 is formed as a projection on cap 12.

Accordingly, as the cover 16 is turned in one direction, the closure member 18 moves away from the opening in the cover, and projection 32A turns the upper tubular portion 20A to an angular position in which it extends out through the hole in the cover, as shown in FIG. 2. When the direction of rotation of the cover is reversed, projection 32B engages the opposite side of upper tubular portion 20A, and rotates the upper tubular portion back to the position shown in FIG. 3, and rotates the hole in the cover to a position in which it is closed by the closure member 18.

The invention provides, therefore, a simple and inexpensive canteen which is designed particularly for children, and which permits the user to drink the liquid in the canteen without the need for removing the cover.

While a particular embodiment of the invention has been shown and described, modifications may be made. It is intended in the claims to cover all modifications which come within the true spirit and scope of the invention.

I claim:

1. A canteen, or the like, including a liquid drink container having an open top and further having a cap removably mounted on the open top; a bushing eccentrically mounted on said cap displaced from the center thereof; elongated tubular means extending through said cap at a position displaced from the center of said cap, said elongated tubular means comprising a first elongated tubular member received in said bushing and extending down from said cap into the interior of said container when said cap is in place on said container, and said elongated tubular means comprising a second tubular member extending into said bushing on the upper side of said cap and coupled to said first tubular member through said bushing to form a drinking straw with said first tubular member; and a cover rotatably mounted on said cap, said cover having an opening therein and means projecting from the internal surface thereof to engage said second tubular member to cause said second tubular member to turn and project through said opening when said cover is turned to a particular angular position with respect to said cap.

2. The combination defined in claim 1, and which includes a further cap rotatably mounted on said bushing, and in which said second tubular member extends radially into said further cap.

3. A canteen, or the like, including a liquid drink container having an open top and further having a cap removably mounted on the open top; elongated tubular means extending through said cap at a position displaced from the center of said cap, said tubular means having a first portion extending downwardly from said cap into the interior of the container, and having a second portion extending essentially perpendicularly to said first portion and displaced upwardly from the top of said cap, said tubular means forming a drinking straw for the canteen; a cover rotatably mounted on said cap, said cover having an opening therein and means projecting from the internal surface thereof to engage the second portion of said tubular means to cause said second portion to turn and project through said opening when said cover is turned to a particular angular position with respect to said cap; a closure member mounted on said cap in position to form a closure for said opening in said cover when said cover is turned to a particular angular position with respect to said cap in which said second portion of said tubular means is retracted through said opening into said cover.

* * * * *